US005433689A

United States Patent [19]

Frins

[11] Patent Number: 5,433,689

[45] Date of Patent: Jul. 18, 1995

[54] EXERCISER'S MAT

[76] Inventor: John J. Frins, 8 E. Clark Pl., Orange, N.J. 07079

[21] Appl. No.: 202,155

[22] Filed: Feb. 25, 1994

[51] Int. Cl.[6] ..... A63B 23/00; A61F 5/00

[52] U.S. Cl. ..... 482/142; 482/140; 601/134; 601/136; 128/845

[58] Field of Search ..... 606/237, 204, 240; 601/134, 136; 5/652, 468, 420, 933; 482/142, 141, 140, 148, 907, 23; 128/845

[56] References Cited

U.S. PATENT DOCUMENTS

| | | | |
|---|---|---|---|
| 1,904,039 | 4/1933 | Bruder | 482/140 |
| 2,511,061 | 6/1950 | Hughes | 602/19 |
| 4,024,861 | 5/1977 | Vincent | 602/17 |
| 4,206,524 | 6/1980 | Cook | 482/142 |
| 4,230,099 | 10/1980 | Richardson | 601/134 |
| 4,621,809 | 11/1986 | Pearl | 482/142 |
| 4,953,857 | 9/1990 | Lemire | 482/142 |
| 5,152,732 | 10/1992 | Sayre | 482/142 |
| 5,279,310 | 1/1994 | Hsien | 128/845 |
| 5,310,401 | 5/1994 | Striano | 602/19 |

*Primary Examiner*—Jerome W. Donnelly
*Attorney, Agent, or Firm*—Bernard J. Murphy

[57] ABSTRACT

A body of limited compressibility, and uniform thickness, defines a support for the posterior of an exerciser during sit-ups, stomach exercises, and the like. A void in the body nestably receives the coccyx area of the exerciser. The body further has an extended member for supporting the exerciser's back, and an elongate void formed in the member comfortably receives the spinal length of the exerciser. Nodules line the edges of the elongate void; these repeatedly knead spine-attached muscles as the exerciser works, supine, on the body.

1 Claim, 1 Drawing Sheet

EXERCISER'S MAT

BACKGROUND OF THE INVENTION

This invention pertains to exercise apparatus and appliances, and in particular to a mat, for use by an exerciser, of novel configuration and construction.

FIELD OF THE INVENTION

Exercisers will lie supine upon thick, gymnasium-type mats, to do sit-ups, and the like. However, such mats are of amorphous nature and, consequently, with frequent use, form areas therein with lumps and recesses. They do not present a uniform and level surface. Alternatively, one will exercise, lying supine, on a bard or such, to avoid having to tend with lumps and voids. Such a firm, unyielding exercise bard, however, causes the exerciser to experience discomfort in the coccyx area, at the base of the spine. Neither exercise boards, nor gymnasium-type mats, offer any means for stimulating the spine-attached muscles.

SUMMARY OF THE INVENTION

It is an object of this invention to set forth a mat, for an exerciser, for use, especially, in supine exercises, which does present a uniform and level surface, is yieldably compressible, isolates the coccyx area, and offers further features, including means for stimulating the spine-attached muscles.

BRIEF DESCRIPTION OF THE DRAWINGS

Further objects of this invention, as well as the novel features thereof, will become apparent by reference to the following description, taken in conjunction with the accompanying figures, in which.

BRIEF DESCRIPTION OF THE PREFERRED EMBODIMENTS

Figure 1:
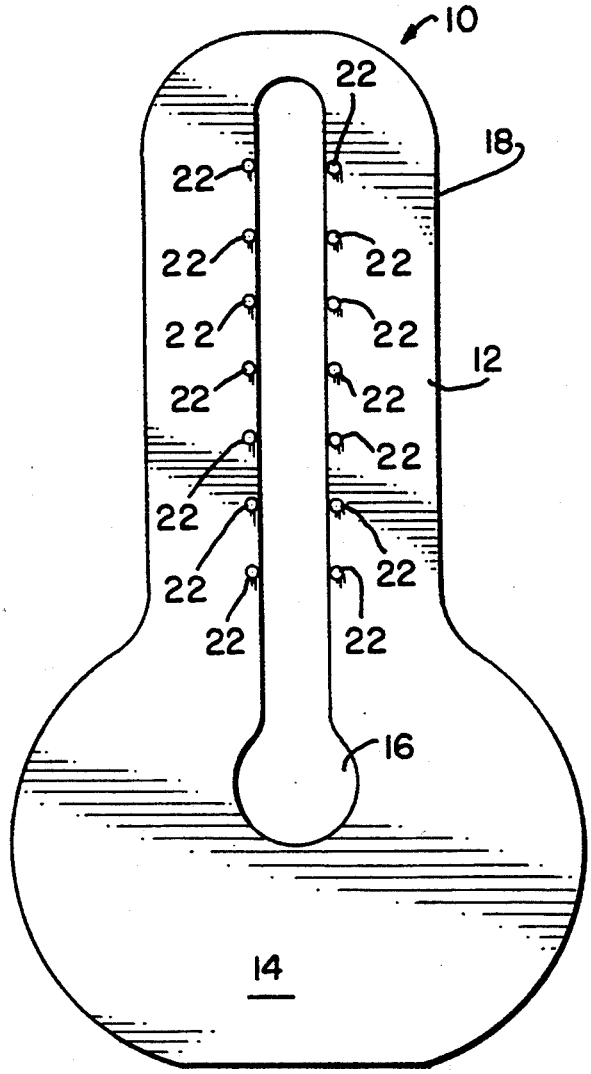
FIG. 1 is a plan view of the novel exerciser's mat, according to an embodiment thereof.
Figure 2:
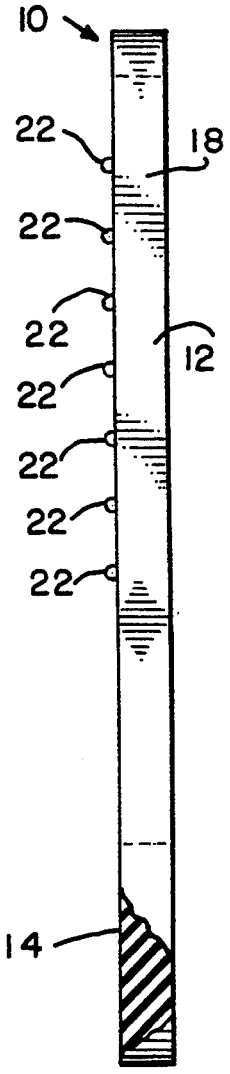
FIG. 2 is a side view thereof,the same taken from the right-hand side of FIG. 2.

As shown in FIGS. 1 and 2, the novel mat 10 comprises an elongate body 12 which, as shown partly broken away in FIG. 2, is formed of so-called hard rubber and as can be seen in the figures, is of uniform thickness (excepting the nodules, of which more is described in the ensuing text). Alternatively the body 12 could be formed of any suitable plastic material which offers a similar, limited yieldability. The body 12 has a pad 14 for supporting thereon the posterior of an exerciser. The pad 14, as can be seen in FIG. 1, has a throughgoing void 16 formed therein for receiving the coccyx area of the exerciser comfortably therewithin.

The body 12, further, has an extended member 18 for supporting the back of the exerciser. The member 18 is contiguous with the pad 14. Whereas, in the use of an exercise bard, the spinal area of the exerciser is uncomfortably pressured, the instant invention, in the extended member 18, offers means for comfortably and slightly recessively nesting therein the spinal length of the exerciser. In this, the member 18 has an axially arranged, throughgoing void 20 formed therein, the same for alignment of the exerciser's spine therewith. Void 20 extends lengthwise, and terminates adjacent an end of member 18 which is opposite pad 14. The voids 16 and 20 open onto each other within the pad 14.

In considerable comfort, albeit with efficiency toward useful exercising, one can lie supine upon the mat 10, with the coccyx area sited upon the void 16, and the spine aligned with the void 20, and perform stomach exercises, sit-ups, and the like.

The mat 10 provides means for stimulating the muscles which, running the length of the exerciser's back, are attached to the spine. In plan view, in FIG. 1, and side view, in FIG. 2, are shown a plurality of nodules 22 of hemispheric configuration. The nodules 22 rim the edges of the void 20. As one lies upon the mat 10, rises up, and lies back down again, the back displaces, slightly, and the nodules 22 massage the aforesaid muscles with each engagement with, and rise from the mat 10. Particularly, when an exerciser lies upon the mat 10, and flexes and draws up his or her knees, alternatively, with hand clasps, the back reciprocates, slightly, and the nodules 22 constantly knead the spine-attached muscles.

Figure 3:
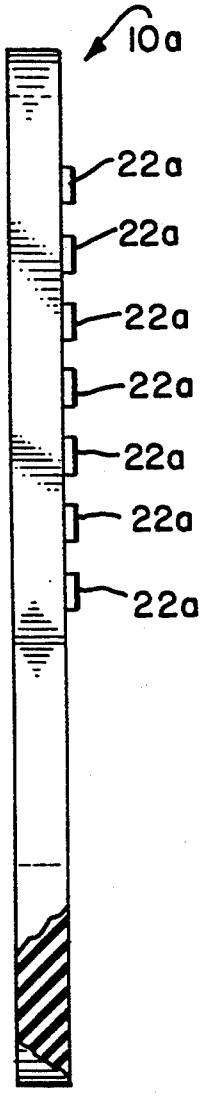
FIG. 3 is a side view of an alternative embodiment of the novel mat, as the same would appear from the left-hand side of a plan view thereof.

The nodules 22 are shown, as noted, of hemispheric configuration. Optionally, they can take the form of linear nodules **22*a*, as shown in FIG. 3, which also rim the void 20 in the member 18**.

In the depicted embodiments 10 and **10*a* of the mat, the nodules 22 and 22*a* are integral with the body 12. The invention also comprehends separable nodules. In such, the rim of the void 20** would have a series of boreholes formed therein, and one could choose from a plurality of nodule types (spherical, hemispherical, linear, etc.) having short stems for entry thereof into the holes provided therefor.

While I have described my invention in connection with specific embodiments thereof, it is to be clearly understood that this is done only by way of example, and not as a limitation to the scope of the invention as set forth in the objects thereof, and in the appended claims. For instance, the mat 10 (and **10*a*) is shown as one continuous component. If desired, the pad 14 and the member 18 could be hingedly joined together. Too, the void 16 could be a separate, fully circular hole, slightly spaced apart from the void 20—which, also could have a termination in adjacency to the void 16. Too, as noted, the nodules 22 and 22*a*** can be supplanted with separable ones. Such alterations, modifications and embodiments of the invention, as will occur to others from my disclosure, are deemed to be within the ambit of my invention and embraced by the following claims.

I claim:

1. An exerciser's mat, comprising:

an elongated body of compressible material having a first end and a second end wherein said body's first end has a first means configured to support thereon the posterior of an exerciser, a second, extended means configured to support the back of an exerciser thereon, said first means has means formed therein adapted to receive the coccyx area of an exerciser therein; wherein said first means comprises a pad;

said coccyx area receiving means comprises a first thoroughgoing void of a predetermined diameter formed in said pad, said back supporting means being contiguous with said pad, and said pad and said back supporting means are of one uniform thickness;

said back supporting means including nesting means formed therein for accepting the spinal area of an exerciser; wherein said nesting means comprises an elongated second thoroughgoing void, of a lesser predetermined cross sectional dimension than said first th roughgoing void, formed within said back supporting means, which terminates adjacent a second end of said elongated body opposite said first end of said elongated body, said voids opening into each to form one continuous void, and;

a plurality of outwardly protruding nodules means rimming substantially the entire length of said elongated second thoroughgoing void, said nodules configured to stimulate muscles attached to the spine of an exerciser.

* * * * *